United States Patent [19]

Babineaux

[11] 4,434,980

[45] Mar. 6, 1984

[54] BOXING DEVICE THAT FIGHTS BACK

[76] Inventor: Bernard J. Babineaux, 139 A. B. Dugas Rd., Lafayette, La. 70503

[21] Appl. No.: 348,089

[22] Filed: Feb. 11, 1982

[51] Int. Cl.[3] ..... A63B 69/34

[52] U.S. Cl. ..... 272/78

[58] Field of Search ..... 272/76–78

[56] References Cited

U.S. PATENT DOCUMENTS

| | | | |
|---|---|---|---|
| 1,685,495 | 9/1928 | Latz . | |
| 2,085,161 | 6/1937 | Kraus | 272/77 |
| 2,909,370 | 10/1959 | Fortney | 272/76 |
| 3,022,072 | 2/1962 | Zinnow | 272/78 |
| 3,250,533 | 5/1966 | Nicholson | 272/76 |

*Primary Examiner*—Richard C. Pinkham
*Assistant Examiner*—Stephen R. Crow
*Attorney, Agent, or Firm*—Guy E. Matthews

[57] ABSTRACT

A boxing device that fights back is disclosed which comprises a coupling suspendable from rigid upper supporting structure, a resilient boxing bag suspended from the coupling and attachable to rigid lower supporting structure, and a pair of arms with their upper ends attached to the coupling and their lower ends free to swing arcutately forward and upward towards an attacker in response to the attacker's blows upon the resilient boxing bag. A second resilient boxing bag, also attachable to the rigid lower supporting structure, may be suspended below the first bag.

5 Claims, 3 Drawing Figures

BOXING DEVICE THAT FIGHTS BACK

BACKGROUND OF THE INVENTION

This invention relates generally to boxing devices and more particularly concerns a boxing device which responds to punches by swinging its own arms at its attacker, thereby fighting back.

Numerous devices are known which provide a sparring partner for a boxer in training. Examples of these devices include those disclosed in U.S. Pat. No. 1,685,495, issued to Latz, U.S. Pat. No. 2,085,161, issued to Krause, U.S. Pat. No. 2,909,370, issued to Fortney, U.S. Pat. No. 3,022,072, issued to Zinnow, and U.S. Pat. No. 3,250,533, issued to Nicholson. Only Fortney and Nicholson disclose arm-like structures which may swing at an attacker in response to a blow. Both of these devices however are expensive and complicated human shaped dummies. The arms of the Fortney device move only in unison and only in a single plane about a single axis. Movement of the arms of the Nicholson device is restricted by the energy absorption of a spring which serves to restore the arms to their original position.

Therefore it is an object of this invention to provide a boxing device that fights back.

It is a further object of this invention to provide a boxing device which response to blows by swinging its arms at its attacker.

It is a further object of this invention to provide an inexpensive, durable, and reliable device for use in the training and practice of boxers.

SUMMARY OF THE INVENTION

A boxing device that fights back is disclosed which comprises a coupling suspendable from rigid upper supporting structure, a resilient boxing bag suspended from the coupling and attachable to rigid lower supporting structure, and a pair of arms with their upper ends attached to the coupling and their lower ends free to swing arcuately forward and upward towards an attacker in response to the attacker's blows upon the resilient boxing bag. A second resilient boxing bag, also attachable to the rigid lower supporting structure, may be suspended below the first bag.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
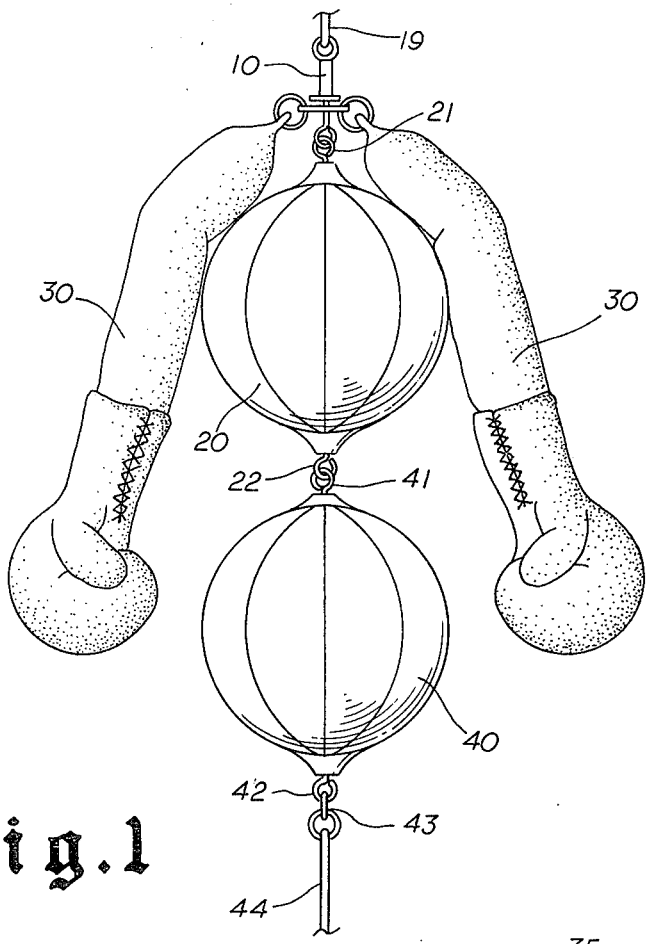
FIG. 1 is a front view of the boxing device of the present invention.

Turning first to FIG. 1, there is shown the boxing device of the present invention, including its main components: coupling 10, an upper boxing bag 20, a pair of arms 30, and a lower boxing bag 40. The boxing device is suspendable from substantially fixed upper supporting structure, such as a ceiling, by a nylon strap 19. It is attachable to substantially fixed lower supporting structure, such as a floor, by resilient strap 44.

Figure 2:
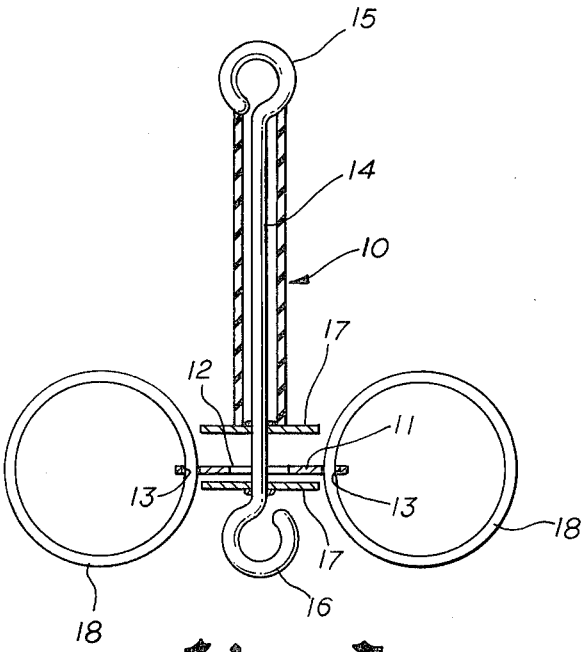
FIG. 2 is a sectional view of the coupling of the boxing device of the present invention.
Figure 3:
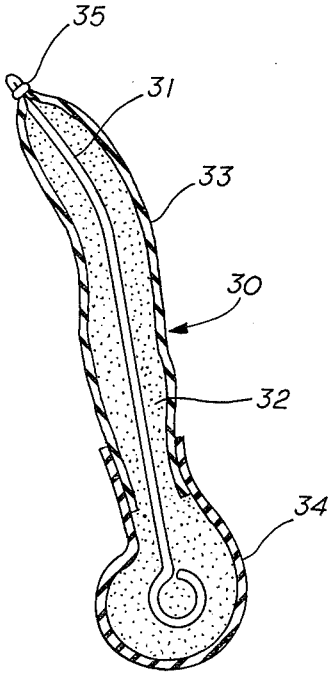
FIG. 3 is a sectional view of the arm of the boxing device of the present invention.

FIG. 2 shows the coupling 10 in greater detail. The coupling 10 includes a flat, horizontal disk 11 having a central hole 12 and an opposed pair of flanking holes 13 therethrough. The vertical rod member 14 has an upper hook 15 at its upper end and a lower hook 16 at its lower end. A pair of abutments 17 are rigidly attached to the vertical rod member 14 above and below the horizontal disk 11, to maintain the substantially perpendicular relationship between the horizontal disk 11 and the vertical rod member 14. A ring 18 passes through each flanking hole 13 of the horizontal disk 11. As shown in FIG. 3, each ring 18 also passes through a hole 35 at the uppermost end of one of the arm 30, thereby connecting the arm 30 to the coupling 10.

Returning to FIG. 1, it can be seen that the upper boxing bag 20 and the lower boxing bag 40 are substantially identical. The upper boxing bag 20 has an upper hook 21 and a lower hook 22, located opposite each other on the surface of the upper boxing bag 20. Similarly, the lower boxing bag 40 has an upper hook 41 and a lower hook 42, also located opposite each other on the surface of the lower boxing bag 40. The lower boxing bag 40 is suspended beneath the upper boxing bag 20 by the engagement of its upper hook 41 with the lower hook 22 of the upper boxing bag 20. The lower hook 42 of the lower boxing bag 40 may be engaged by a swivel 43 which is attached to a resilient strap 44, which may in turn be attached to the floor or some other substantially rigid lower supporting structure.

Turning now to FIG. 3, it can be seen that each arm 30 comprises an elongated structural member 31 enclosed in padding 32 which is in turn itself enclosed in a durable, nonabrasive cover material 33. The lowermost end of the arm 30 is fitted with a boxing glove 34. The uppermost end of each arm 30 has therethrough a hole 35 through which is passed the one of the rings 28 of the coupling 10, thereby attaching each arm 30 to the coupling 10 and to the upper boxing bag 20.

This boxing device is intended to be used when installed between the substantially fixed upper supporting structure such as the ceiling and the substantially fixed lower supporting structure such as the floor. The boxing device is attached to the ceiling by a substantially nonresilient upper strap 19. It is attached to the floor by a resilient lower strap 44. The weight of the boxing bag is supported by the upper strap 19.

In use, the boxer strikes one of the boxing bags 20 or 40 in the same manner that he would strike an ordinary boxing bag. The resilient bags 20 and 40 will move sharply backwards in response to the blow, carrying coupling 10 with them. The sharp backward movement of the coupling 10 will move the upper ends of the padded arms 30 backward, causing the unrestrained lower ends of the padded arms 30 and the boxing gloves 34 thereon to swing forward in an arc, carrying the boxing gloves 34 upward towards the source of the blow. This motion of the arms 30 simulates that of a live sparring partner, training the boxer to dodge the blows of the arms 30.

Thus it is apparent that there has been provided, in accordance with the invention, a boxing device that fights back that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A boxing device, comprising:

a coupling suspendable from a substantially fixed supporting structure;

a resilient boxing bag having on its surface an upper hook suspended from the coupling and also having a lower hook on its surface opposite the upper hook, the lower hook being attachable to a substantially fixed lower supporting structure; and a pair of elongated, padded arms, each having a blunt, padded lower end and each arm being connected to the coupling and hanging from the coupling adjacent opposite sides of the boxing bag, so that each arm may move arcuately forward in response to an impact force applied to the boxing bag, each arm thereby thrusting its blunt, padded lower end forward and upward towards a source of the impact force.

2. The boxing device of claim 1, wherein the boxing bag comprises a first boxing bag and further comprising a second boxing bag also having an upper and an opposed lower hook on its surface, with the upper hook of the second boxing bag being suspended from the lower hook of the first boxing bag, and with the lower hook of the second boxing bag being attachable to the substantially fixed lower supporting structure.

3. The boxing device of claim 1 wherein the coupling comprises:

a substantially flat horizontal member having a central vertical hole flanked by an opposed pair of vertical side holes:

a vertical member passing through the central hole and having hook means at its upper and lower ends, with the upper hook means suspendable from the upper supporting structure and the lower hook means attached to the upper hook of the boxing bag; and a pair of ring members each passing through one of the side holes of the horizontal member and through a hole in the upper end of one of the elongated, padded arms.

4. The boxing device of claim 3, wherein the vertical member has horizontal abutments rigidly attached thereto both above and below the horizontal member so as to retain the horizontal member substantially perpendicular to the vertical member.

5. The boxing device of claim 1, wherein each of the elongated padded arms comprises a central elongated structural member surrounded by padding which is itself surrounded by a durable, nonabrasive surface, and wherein the blunt, padded lower end of the elongated, padded arm comprises a boxing glove.

* * * * *